United States Patent [19]

Fujiwara et al.

[11] Patent Number: 4,689,198

[45] Date of Patent: Aug. 25, 1987

[54] AUSTENITIC STAINLESS STEEL WITH HIGH CORROSION RESISTANCE AND HIGH STRENGTH WHEN HEAT TREATED

[75] Inventors: Kazuo Fujiwara, Kobe; Yasushi Torii, Kakogawa; Koujiro Kitahata, Akashi; Tsuyoshi Inoue, Kobe; Tadamasa Yokoyama, deceased, late of Ohtsu, all of Japan, by Keiko Yokoyama, legal heir and representative

[73] Assignee: Kabushiki Kaisha Kobe Seiko Sho, Kobe, Japan

[21] Appl. No.: 786,960

[22] PCT Filed: Feb. 7, 1985

[86] PCT No.: PCT/JP85/00051

§ 371 Date: Oct. 3, 1985

§ 102(e) Date: Oct. 3, 1985

[87] PCT Pub. No.: WO85/03528

PCT Pub. Date: Aug. 15, 1985

[30] Foreign Application Priority Data

Feb. 9, 1984 [JP] Japan ..... 59-23702
Apr. 10, 1984 [JP] Japan ..... 59-72068

[51] Int. Cl.[4] ..... C22C 38/44

[52] U.S. Cl. ..... 420/47; 420/53; 420/55; 420/57; 420/59; 420/66; 420/69; 148/325; 148/327

[58] Field of Search ..... 75/128 A, 128 G, 128 T, 75/128 N, 128 W, 128 V; 148/38, 325, 327; 420/47, 53, 55, 57, 59, 66, 69

[56] References Cited

U.S. PATENT DOCUMENTS 3,592,634 7/1971 Denhard et al. ..... 75/128 V
4,486,231 12/1984 Fujiwara et al. ..... 75/128 A

*Primary Examiner*—Melvyn J. Andrews
*Assistant Examiner*—Deborah Yee
*Attorney, Agent, or Firm*—Oblon, Fisher, Spivak, McClelland, & Maier

[57] ABSTRACT

Disclosed herein is a high strength austenitic stainless steel with excellent corrosion resistance even in oxidative enviroments, and a method for producing such stainless steel, in which the kinds and proportions of the component elements are strictly restricted, especially limiting the contents of C and N to achieve solution strengthening while preventing degradations in corrosion resistance and defects of steel ingots which would be caused if they are added excessively. Besides, V is added under coexistence with Cr and Ni to increase the strength by precipitation of carbides and nitrides of V while preventing production of Cr carbides.

8 Claims, 1 Drawing Figure

AUSTENITIC STAINLESS STEEL WITH HIGH CORROSION RESISTANCE AND HIGH STRENGTH WHEN HEAT TREATED

FIELD OF THE ART

This invention relates to austenitic stainless steel with high corrosion resistance in oxidative enviroments along with strength of high level, and a method for producing such a stainless steel.

STATE OF THE ART

The concerns over exhaustion of petroleum resources form the background of recent efforts for expansion and stabilization of energy resources, including efforts on the sea for the development of underwater oil fields and efforts on the ground in boring the so-called sour gases and sour oil which have thus far been neglected due to the contents of oxidative gases such as hydrogen sulfide and carbon dioxide. Naturally, the materials and equipments related to the production such energy sources are unavoidably brought into contact with chlorides and oxidative gases, and the steel materials to be useed in this field are required to have corrosion resistance first of all and to meet severer conditions in strength as the wells become deeper. In addition, they are required to have toughness at low temperature for use in cold regions.

As materials which can meet these requirements, there have been known various alloys such as Ni-base alloys, Ti-base alloys and Co-base alloys, which are however very costly as compared with ordinary low alloy steels. In contrast, austenitic stainless steels, for example, have been known as a relatively inexpensive material, but they are inferior in corrosion resistance-strength balance as well as in chloride corrosion resistance.

On the other hand, martensitic stainless steels which are almost satisfactory in strength have a drawback that they are extremely low in resistance to sulfide stress corrosion cracking.

The methods generally resorted to for the improvement of yield strength of austenitic stainless steels include, in addition to solid solution strengthening with C and N, precipitation hardening and work hardening. The precipitation hardening and work hardening impose adverse effects on corrosion resistance, while a larger C-content deteriorates the corrosion resistance of the steel by producing Cr carbides and a larger N-content gives rise to defects in the ingot-making stage.

DISCLOSURE OF THE INVENTION

Under these circumstances, the present invention has as its object the provision of an austenitic stainless steel with improved corrosion resistance and high strength, more particularly, an austenitic stainless steel which shows excellent corrosion resistance and high strength even in an enviroment containing chlorides and sulfides and which is improved also in machinability such as elongation and drawability.

It is another object of the present invention to provide a method for producing an austenitic steel which has improved corrosion resistance and strength as mentioned above.

In order to achieve the foregoing objectives, the present inventors conducted an intensive study and as a result found that both the yield strength and corrosion resistance of austenitic steel can be improved by delimiting the C and N contents of the steel to prevent degradations in corrosion resistance and defects of steel ingots in the casting stage, and suppressing production of Cr carbides by incorporating V in coexistence with Cr and Ni, while dispersing precipitation of carbides or nitrides of V for improvement of the yield strength. Further, the machinability such as elongation and drawability of the steel can be improved markedly by subjecting same to a heat treatment under predetermined conditions.

Namely, the austenitic stainless steel with high corrosion resistance and strength according to the invention contains by weight percentage:

0.05–0.15% of C;
0.10–0.50% of Si;
0.5–5.0% of Mn;
18–25% of Cr;
6–10% of Ni;
2–4% of Mo;
0.05–0.25% of V;
0.15%–0.45% of N;

optionally at least one element selected from 0.15–0.50% of Nb and 0.01–0.50% of Ti; and the balance of iron and inevitable impurities.

According to the present invention, there is also provided a method for producing the above-mentioned austenitic stainless steel with high corrosion resistance and strength, the method comprising: subjecting an austenitic stainless steel of the above-defined composition to a solution treatment at a temperature of 1030°–1100° C., immediately followed by a tempering treatment at a temperature of 250°–500° C.

The above and other objects, features and advantages of the invention will become apparent from the following description and appended claims, taken in conjunction with the accompanying drawing.

BRIEF DESCRIPTION OF THE DRAWING

In the accompanying drawing:

The sole FIGURE is a graph showing the values of [100C%+20Si%+Ni%+60N%] of austenitic stainless steel specimens used in experiments, in relation with 0.2% proof strength and corrosion resistance.

THE BEST MODE FOR CARRYING OUT THE INVENTION

Figure 1:
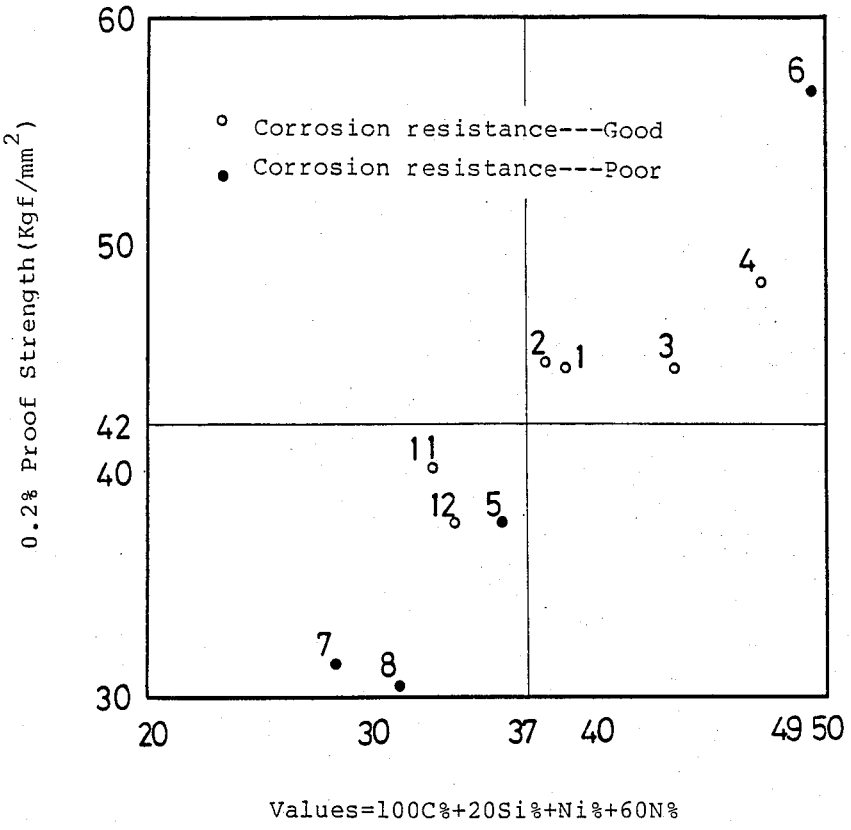

The austenitic stainless steel of the present invention is restricted to the above-defined composition for the following reasons.

The element C has an effect of stabilizing austenite along with an effect of improving strength, including yield strength of the steel, as an intersticial solution strengthening element. In the present invention, for the purpose of enhancing yield strength and toughness of the steel by precipitation of fine carbonitrides under coexistence of Ni and V, it is necessary to add C in an amount greater than 0.05% but not in excess of 0.15% as it would deteriorate corrosion resistance by producing Cr carbides. Consequently, the content of C should be in the range of 0.05–0.15%.

The element Si needs to be added more than 0.10% as a deoxidizer of the steel. If added excessively, it would increase weld crack sensitivity and might cause cracking in the hot rolling stage. Therefore, the content of Si should be limited to 0.50%.

The element Mn is necessary as a deoxidizer similarly to Si, and needs to be added more than 0.5% for increasing the amount of N in solid solution, for stabilizing austenite and for impriving the resistance to weld cracking. However, if added in excess of 5%, it would bring about problems including impairment of hot workability. Accordingly, the content of Mn is preferred to be in the range of 0.5–5%, more preferably in the range of 2.0–4.0% from the standpoint of improving the resistance to weld cracking.

In the present invention, the element Cr is essential for the improvement of corrosion resistance of the steel and at the same time for increasing the solid solubility of N. However, if added excessively, it would disturb the austenite-ferrite balance, and undesirably makes it necessary to add a large quantity of costly Ni for maintaining required properties of the steel. Thus, the content of Cr should be in the range of 18–25%.

The element Ni is essentially necessary and added in an amount balancing with Cr, for improving corrosion resistance and mechanical properties of the steel. For these purposes, it should be added more than 8.0%, but on the contrary a Ni content which is excessive relative to Cr will rather deteriorates the corrosion resistance. Therefore, the content of Ni should be limited to 10%.

The element Mo is essential for the improvement of the corrosion resistance of the steel, particularly for preventing corrosion in gaps and holes. For these purposes, it should be added more than 2%. However, an excessive Mo content is only met by saturation of its effect on the improvement of the corrosion resistance, and by a higher product cost. Accordingly, the content of Mo should be limited to 4%.

In the present invention, the element V is necessary for improving the balance between the strength, toughness and corrosion resistance of the steel. Especially for improving the corrosion resistance while preventing production of Cr carbides and for enhancing the yield strength by dispersed precipitation of carbonitrides of V, it should be added more than 0.05%. However, if added excessively, it would urge ferrite production and disturb the balance between austenite and ferrite, deteriorating the corrosion resistance. Therefore, the content of V should be limited to 0.25%.

Similarly to C, N is an austenite-forming element and has the effects of improving the yield strength of the steel and enhancing the toughness by forming fine carbonitrides. To produce these effects satisfactorily, it should be added more than 0.15%. However, since N would cause troubles in the ingot-making stage if added excessively, its content should be limted to 0.45%.

In addition to the above-mentioned elements, the austenitic stainless steel of the present invention may contain at least one element selected from Nb and Ti.

Nb is known as an element which stabilizes C by forming carbides, but it improves both the yield strength and toughness by production of fine carbides in the case of a steel with a high N content. It should be contained more than 0.05% in order to produce these effects. However, an excessive content of Nb would deteriorate the weldability and, since Nb is an element which forms stable carbonitrides, it would invite reductions in the amounts of C and N in solid solution, rather lowering the yield strength, and it would impair the toughness by forming primary carbonitrides. Accordingly, the content of Nb should be limited to 0.50%.

Similarly to Nb, the element Ti which forms very stable carbonitrides has an effect of improving the yield strength of the steel if added in a range of 0.01–0.50%, but it would invite degradations in yield strength and toughness if added in an excessive amount. Therefore, the content of Ti should be restricted to the above-defined range.

The austenitic stainless steel according to the invention contains the above-mentioned essential elements along with the balance consisting of iron and inevitable impurities, in which especially the contents of C and N are limited for preventing degradations in the corrosion resistance as caused by excessive C and N contents and for attaining solution strengthening while preventing defects in the ingot-making stage. Besides, as the steel contains V in coexistence with Cr and Ni, the solution strengthening and precipitation strengthening are balanced by supression of production of Cr carbides and dispersion of carbonitrides of V, to produce an austenitic stainless steel which is improved in corrosion resistance in an oxidative enviroment as well as in yield strength.

In the present invention, the yield strength and corrosion resistance of the austenitic stainless steel are improved further more by adjusting the contents of C, Si, Ni and N which particularly contribute to the yield strength among the above-mentioned essential elements, into percentages which satisfy the following formula.

$$37 \leqq 100C\% + 20Si\% + Ni\% + 60N\% \leqq 49$$

Namely, if the value of the foregoing formula exceeds 49, it will become difficult to secure sufficient corrosion resistance, and, if smaller than 37, the balance between corrosion resistance and yield strength will be disturbed, inviting degradations in one of these properties.

The austenitic stainless steel with the above-defined composition has excellent properties, satisfying the requirements in both corrosion resistance and yield strength. However, the properties in these aspects as well as machinability such as elongation and drawability can be improved further by employing a method of water- or oil-quenching the austenitic stainless steel after a solution treatment at a temperature of 1030° C. to 1100° C., followed by a tempering treatment at a temperature of 250° C. to 500° C. Namely, a solution treatment in the above-mentioned temperature range can achieve solid solution of Cr carbides, softening at the time of recrystallization, improvement of corrosion resistance and relief of internal stress. If the solution treatment temperature is lower than 1030° C., the solubization in solid of Cr carbides becomes insufficient, and undissolved Cr carbides remain in the steel, in some cases failing to improve the corrosion resistance of the steel to a satisfactory degree. On the other hand, if the temperature of the solution treatment is higher than 1100° C., carbides of V, Nb, Ti and the like are also dissolved so that there is a possibility of inviting degradations in yield strength. An especially preferred temperature range for the solution teatment is 1040° C. to 1080° C.

It is necessary to increase the heating time period of the solution treatment in proportion to the thickness of the steel material, normally at the rate of 1 hour for a thickness of 25 mm. In cooling the steel upon completion of the solution treatment, it is necessary to quench it by oil quenching or more quick quenching, namely, with an average cooling speed higher than about 0.2° C./sec, preferably quenching the steel quickly in a temperature range of, for example, 900°–500° C. where Cr carbides tend to precipitate at intergranular regions, for the purpose of securing excellent corrosion resistance.

According to the method of the invention, the steel may be subjected to a tempering treatment at a temperature of 250°-500° C. subsequent to the solution treatment to remove thermal strain from the steel, thereby to improve not only its corrosion resistance and yield strength but also its elongation and drawability all the more. Namely, the hardening effect of the quenching is moderated by the tempering treatment to the above-mentioned temperature range to remove the thermal strain resulting from the solution treatment. If the tempering temperature is lower than 250° C., it is difficult to remove thermal strain to a sufficient degree, with possibilities of degrading the resistance to stress corrosion cracking of the steel. On the other hand, if higher than 500° C., it is likely that the corrosion resistance and mechanical properties are deteriorated by precipitation of Cr carbides at intergranular regions. Therefore, the tempering temperature is preferred to be in the range of 350°-500° C., more preferably to be in the range of 400°-500° C.

Heretofore, austenitic stainless steels have been considered that their corrosion resistance is highest after a solution treatment and is deteriorated by heating in a subsequent stage due to precipitation of Cr carbides. However, according to the method of the invention, the mechanical properties such as elongation and drawability are improved without impairing the excellent corrosion resistance of the steel by the tempering treatment in a temperature range which has thus far been considered to induce the low-temperature sensitization phenomenon.

The invention is illustrated more particularly by the following examples.

The methods of corrosion tests and rating were as follows.

[Sulfide Stress Corrosion Cracking Test]

Specimens were stressed by U-bending, and immersed for 1 month in an NACE solution (5%NaCl solution+0.5% acetic acid+saturation with 1 atm. hydrogen sulfide gas), thereafter examining the conditions of cracks, if any, by a microscope (magnification: 100).

[Chloride Stress Corrosion Cracking Test]

U-bent specimens were sealed in an autoclave along with artificial sea water saturated with air, and retained therein for 1 month in heated state at 100° C., thereafter examining the conditions of cracks, if any, by a microscope at the magnification 100.

[Gap Corrosion Test]

A coupled of test sheets which are fastened to each other by a bolt and a nut and sealed with polytetrafluoroethylene were immersed for two weeks in artificial sea water of 50° C. the pH of which was adjusted to 3.5 by the use of hydrochloric acid. Thereafter, the condition of gap corrosion was examined by eye observation and reductions in weight.

[Hole Corrosion Test]

Test pieces in the form of flat sheets were immersed for 1 month in artificial sea water at 50° C. the pH of which was adjusted to 3.5 by the use of hydrochloric acid, examining the condition of hole corrosion by eye observation and reductions in weight.

EXAMPLE 1

Shown in Table 1 are the chemical compositions of steels according to the invention and commercially available conventional materials along with their values of the formula indicated at the foot note, while shown in Table 2 are their ratings in mechanical properties and corrosion resistance. Specimen Nos. 1 to 4 are of steels produced by a process including the the solution treatment, and specimen Nos. 5 to 10 are of commercially available steels. Specimen Nos. 11 and 12 fall in the range of the invention in chemical composition but not in the value of the formula in the foot note.

As clear from these examples, the steels according to the present invention are improved in all of resistance to sulfide stress corrosion cracking, resistance to chloride stress corrosion cracking, resistance to gap corrosion and resistance to hole corrosion, and possess a proof strength higher than about 45 kgf/mm$^2$, showing a good balance between the corrosion resistance and strength and a superior impact strength. However, specimens Nos. 5 to 10 of conventional steels are disturbed in the balance between these properties, marking an inferior value in both or either one of corrosion resistance and proof strength. Specimens 11 and 12 are satisfactory in corrosion resistance but are inferior in proof strength. Thus, it will be understood that the corrosion resistance and proof strength are both satistory when the value of the composition formula is in the predetermined range.

TABLE 1

| Steels | C | Si | Mn | Cr | Ni | Mo | V | Nb | Ti | N | Cu | F-value* |
|---|---|---|---|---|---|---|---|---|---|---|---|---|
| Invention | | | | | | | | | | | | |
| 1 | 0.12 | 0.33 | 0.94 | 19.34 | 8.16 | 3.01 | 0.12 | — | — | 0.199 | — | 38.7 |
| 2 | 0.09 | 0.32 | 3.95 | 22.36 | 7.86 | 2.97 | 0.10 | — | — | 0.244 | — | 37.9 |
| 3 | 0.11 | 0.30 | 1.15 | 22.82 | 9.85 | 2.89 | 0.22 | — | 0.05 | 0.279 | — | 43.6 |
| 4 | 0.12 | 0.28 | 2.95 | 24.84 | 9.95 | 2.96 | 0.13 | 0.20 | — | 0.325 | — | 47.1 |
| Conventional | | | | | | | | | | | | |
| 5 | 0.03 | 0.33 | 2.94 | 22.82 | 11.95 | 3.07 | — | — | — | 0.239 | — | 35.9 |
| 6 | 0.09 | 0.32 | 3.44 | 24.82 | 17.09 | 3.45 | 0.27 | 0.23 | — | 0.284 | — | 49.5 |
| 7 | 0.07 | 0.57 | 1.38 | 18.24 | 8.34 | — | — | — | — | — | — | 28.5 |
| 8 | 0.06 | 0.66 | 1.19 | 16.87 | 10.35 | 2.33 | — | — | — | — | — | 31.4 |
| 9 | 0.03 | 0.74 | 0.88 | 16.36 | 3.82 | — | — | 0.35 | — | — | 3.93 | 23.4 |
| 10 | 0.05 | 0.70 | 1.27 | 24.62 | 4.66 | 1.48 | — | — | — | — | — | 25.5 |
| 11 | 0.10 | 0.26 | 0.98 | 18.57 | 7.50 | 3.02 | 0.25 | — | — | 0.169 | — | 32.8 |
| 12 | 0.12 | 0.23 | 1.00 | 18.68 | 7.52 | 2.98 | 0.11 | — | — | 0.160 | — | 33.7 |

Note:
*F-value = the value of 100 C % + 20 Si % + Ni % + 60 N %

TABLE 2

| Steels | Mechanical Properties: 0.2% p. str. (kgf/mm²) | Tensile str. (kgf/mm²) | Elongation (%) | Charpy vEo (kg · m) | Corrosion Resistance: Sulfide cracking | Chloride cracking | Gap cor. | Hole cor. |
|---|---|---|---|---|---|---|---|---|
| 1 | 44.6 | 77.4 | 61.8 | 30.4 | O | O | O | O |
| 2 | 44.7 | 78.9 | 57.4 | 38.3 | O | O | O | O |
| 3 | 44.5 | 82.0 | 59.5 | 38.6 | O | O | O | O |
| 4 | 48.2 | 87.2 | 45.3 | 34.4 | O | O | O | O |
| 5 | 37.8 | 76.8 | 55.8 | 33.6 | O | O | O | O |
| 6 | 56.7 | 92.3 | 27.4 | 1.7 | X | O | O | O |
| 7 | 31.6 | 66.9 | 55.5 | 30.5 | X | X | X | X |
| 8 | 30.5 | 59.3 | 58.2 | 27.8 | O | X | X | X |
| 9 | 75.1 | 98.9 | 25.7 | 28.6 | X | O | X | X |
| 10 | 63.2 | 74.2 | 30.7 | 5.6 | O | X | O | X |
| 11 | 40.2 | 82.8 | 50.4 | 30.7 | O | O | O | O |
| 12 | 37.8 | 88.6 | 59.3 | 28.9 | O | O | O | O |

(Note)
In the columns of Corrosion Resistance, the marks "O" and "X" indicate absence and presence of cracking or gap or hole corrosion, respectively.

Specimens of the steel indicated at A in Table 3 were heated to various temperatures in the solution treatment, and possessed mechanical properties as shown in Table 4. It will be seen therefrom that especially elongation is improved by tempering at a temperature of 450° C. after a solution treatment at a temperature higher than 1030° C. The results of stress corrosion crack test of the respective steels are also shown in Table 4. It is observed therefrom that the corrosion resistance is similarly improved by a solution treatment at a temperature higher than 1030° C.

Nextly, the steel specimens at A to C of Table 3 were water-cooled subsequent to a solution treatment, and tempered at various temperatures. The mechanical properties and results of stress corrosion crack test of these specimens are shown in Table 5. Steel specimen A was water-cooled after a solution treatment at 1040° C., while steel specimen B was water-cooled after a solution treatment at 1050° C. and then tempered at 450° C.

It will be obvious that the elongation of a steel is improved remarkably without impairing its excellent corrosion resistance by quenching the steel after a solution treatment, followed by a tempering treatment in a predetermined range according to the method of the invention.

TABLE 3

| Steels | Chemical Composition (wt %): C | Si | Mn | P | S | Cr | Ni | Mo | V | N | Others | F-Value* |
|---|---|---|---|---|---|---|---|---|---|---|---|---|
| A | 0.12 | 0.20 | 3.50 | <0.02 | <0.01 | 21.0 | 8.5 | 3.0 | 0.11 | 0.29 | | 41.9 |
| B | 0.11 | 0.27 | 3.63 | 0.014 | 0.010 | 20.3 | 7.8 | 2.9 | 0.12 | 0.27 | Nb 0.22 | 40.4 |
| C | 0.13 | 0.23 | 3.45 | 0.011 | 0.006 | 21.0 | 8.4 | 3.2 | 0.12 | 0.30 | Ti 0.05 | 44.0 |

Note:
*The value of 100 C % + 20 Si % + Ni % + 60 N %

TABLE 4

| Steel specimens | | Solution treatment temp. (°C.) | Yield strength (kgf/mm²) | Tensile strength (kgf/mm²) | Elongation (%) | Corros. rate (g/m² · hr) | Cracking | Hole/gap corros. |
|---|---|---|---|---|---|---|---|---|
| A | 1 | 970 | 45 | 70 | 26 | 0.055 | Yes | Yes |
| | 2 | 1000 | 44 | 75 | 38 | 0.030 | Yes | Yes |
| | 3 | 1030 | 44 | 78 | 60 | 0.004 | Finely | Nil |
| | 4 | 1060 | 44 | 78 | 67 | <0.001 | Nil | Nil |
| | 5 | 1090 | 42 | 78 | 70 | <0.001 | Nil | Nil |

TABLE 5

| Steel specimens | | Tempering temp. (°C.) | Yield strength (kgf/mm²) | Tensile strength (kgf/mm²) | Elongation (%) | Corros. rate (g/m² · hr) | Cracking | Hole/gap corros. |
|---|---|---|---|---|---|---|---|---|
| A | 6 | 550 | 45 | 77 | 58 | 0.005 | Yes | Nil |
| | 7 | 450 | 43 | 78 | 68 | <0.001 | Nil | Nil |
| | 8 | 350 | 43 | 77 | 62 | <0.001 | Nil | Nil |
| | 9 | 250 | 43 | 76 | 55 | <0.001 | Nil | Nil |
| | 10 | — | 43 | 75 | 44 | <0.001 | Nil | Nil |
| B | 11 | 450 | 44 | 74 | 67 | <0.001 | Nil | Nil |
| C | 12 | 450 | 46 | 76 | 65 | <0.001 | Nil | Nil |

POSSIBILITIES OF INDUSTRIAL UTILIZATION

As clear from the foregoing description, according to the present invention, the kinds and proportions of the component elements are strictly restricted, especially limiting the contents of C and N to achieve solution strengthening while preventing degradations in corrosion resistance and defects of steel ingots, which would be caused by excessive contents of these elements. Besides, V is added under coexistence with Cr and Ni to balance V and precipitation hardening while suppressing production of Cr carbides, making it possible to obtain an austenitic stainless steel which has excellent corrosion resistance and yield strength of high level in oxidative enviroments. Further, by strictly restricting the conditions of a solution treatment of the stainless steel and a subsequent tempering treatment, not only the corrosion resistance and strength but also machinability such as elongation and drawability of the steel can be improved all the more to provide structural materials which are extremely useful as equipments for boring undersea oil fields and natural gases where contact with the so-called sour oils and sour gases is unavoidable.

What we claim is:

1. A high strength austenitic stainless steel with excellent corrosion resistance in oxidative enviroments, said austenitic stainless steel consisting of in percentage by weight:

0.11–0.15% of C;
0.10–0.50% of Si;
0.5–5.0% of Mn;
18–25% of Cr;
6–10% of Ni;
2–4% of Mo;
0.05–0.25% of V;
0.15–0.45% of N; and the balance iron and inevitable impurities.

2. A high strength austenitic stainless steel with excellent corrosion resistance in oxidative enviroments, said austentic stainless steel consisting of in percentage by weight:

0.11–0.15% of C;
0.10–0.50% of Si;
0.5–5.0% of Mn;
18–25% of Cr;
6–10% of Ni;
2–4% of Mo;
0.05–0.25% of V;
0.15–0.45% of N;

and at least one element selected from 0.05–0.50% of Nb and 0.01–0.50% of Ti; and the balance iron and inevitable impurities.

3. The austenitic stainless steel of claims 1 or 2, wherein C, Si, Ni and N are in proportions satisfying the condition of $37 < 100C\% + 20Si\% + Ni\% + 60N\% < 49$.

4. The austenitic stainless steel of claims 1 or 2 in which its high strength and corrosion resistance is imparted to it by subjecting the austenitic stainless steel to a solution treatment at a temperature of 1030°–1100° C.

5. The austenitic stainless steel of claims 1 or 2 in which its high strength and corrosion resistance is imparted to it by subjecting the austenitic stainless steel to a solution treatment at a temperature of 1030°–1100° C., followed by a tempering treatment at a temperature of 250°–500° C.

6. The steel of claim 4 wherein the temperature of said solution treatment temperature is in the range of 1040° C.–1080° C.

7. The steel of claim 5, wherein the temperature of said tempering treatment is in the range of 350° C.–500° C.

8. The steel of claim 5, wherein the temperature of said tempering treatment is in the range of 400° C.–500° C.

* * * * *